US005894957A

United States Patent [19]

Egel

[11] Patent Number: 5,894,957

[45] Date of Patent: Apr. 20, 1999

[54] SANITARY KETCHUP DISPENSER

[76] Inventor: Kent D. Egel, 1523 231st St., Letts, Iowa 52754

[21] Appl. No.: 08/757,376

[22] Filed: Nov. 27, 1996

[51] Int. Cl.[6] ..... B65D 35/28; B65D 35/56; B67D 5/42; A23G 3/24

[52] U.S. Cl. ..... 222/95; 222/105; 222/386; 118/26; 118/27

[58] Field of Search ..... 222/95, 105, 386; 118/26, 27

[56] References Cited

U.S. PATENT DOCUMENTS

| | | | |
|---|---|---|---|
| 2,436,291 | 2/1948 | Daniel | 215/43 |
| 3,325,061 | 6/1967 | Ellsworth | 222/386 |
| 3,593,888 | 7/1971 | Brown . | |
| 3,799,399 | 3/1974 | DiBattista . | |
| 3,861,284 | 1/1975 | Costello | 99/321 |
| 3,938,686 | 2/1976 | Milligan et al. | 215/232 |
| 4,138,041 | 2/1979 | Capo et al. . | |
| 4,454,964 | 6/1984 | Sacher . | |
| 4,765,512 | 8/1988 | Bull, Jr. . | |
| 4,805,809 | 2/1989 | Harris . | |
| 4,880,125 | 11/1989 | LeBeau | 222/95 |
| 5,259,537 | 11/1993 | Beers et al. . | |
| 5,277,920 | 1/1994 | Weaver, Jr. | 426/115 |
| 5,337,925 | 8/1994 | Ferrara, Jr. | 222/214 |
| 5,676,990 | 10/1997 | Wawrzynski | 118/13 |

*Primary Examiner*—Andres Kashnikow
*Assistant Examiner*—Keats Quinalty
*Attorney, Agent, or Firm*—Chase & Yakimo, L.C.

[57] ABSTRACT

A condiment container comprises a housing with optional swingable lid. A flexible pouch with condiment therein is mounted within the housing, the pouch presenting a top surface having a plurality of score lines therein. Upon squeezing the housing the perforations separate to allow access to the condiment within the pouch. In one embodiment a vertical slot extends along the housing and has a tab projecting therethrough, the tab connected to a movable base which is slidable within the confines of the housing. Upon user exertion on the tab the movable base will move towards the top of the pouch so as to decrease the pouch volume and urge the condiment towards or through the top of the pouch. Alternatively, the movable bottom can be accessed by user pressure thereon through the bottom of the housing.

10 Claims, 9 Drawing Sheets

SANITARY KETCHUP DISPENSER

BACKGROUND OF THE INVENTION

This invention relates to a condiment dispenser and, more particularly, to a portable dispenser for transporting and/or presenting a condiment for use with a food product, such as a french fry or the like.

In today's on-the-go society, the drive-in purchase and consumption of fastfood products such as hamburgers, french fries, etc. are common. Heretofore, plastic packets containing ketchup, mustard or mayonnaise for use with the purchased food product was provided. These packets are difficult to open and hard to control a product flow therefrom, particularly when driving a vehicle. Moreover, once the packet is opened, a controlled dispensation of the condiment onto the food product is difficult. Thus messes will occur. Accordingly, it is desirable to avoid these problems.

In response thereto I have invented a container for transporting a food condiment or food product comprising an outer housing with lid, the housing having handles extending therefrom. Within the housing is a collapsible pouch for the desired condiment, the pouch having score lines in the top surface. At the bottom of the housing is a movable base with handle extending through a slot vertically extending along the side of the housing. Upon pressure being exerted on the housing the score lines will separate so as to present an inlet/opening for allowing access to the condiment stored within the pouch. Upon moving the tab along the slot the base collapses the pouch so as to urge the condiment towards the top of the pouch and through the now open top. The food product is inserted through the opening and into the pouch. Excess condiment is removed from the food product by edges of the opening upon withdrawal of the product through the opening. The use of my container provides for easy transport of the condiment while diminishing messes associated with condiment use.

It is therefore a general object of this invention to provide for a transportable container for food condiments, food products and the like.

Another object of this invention is to provide a container, as aforesaid, having a collapsible condiment pouch within the transport container.

A still further object of this invention is to provide a container, as aforesaid, having a movable base for urging the contents of the condiment pouch towards an upper open end thereof.

Another object of this invention is to provide a condiment container with pouch, as aforesaid, the pouch having a plurality of score lines therein which separate under pressure to present an opening for insertion of the food product into the pouch as well as for removal of excess condiment from the food product upon withdrawal from the pouch.

A further object of this invention is to provide a container, as aforesaid, having a lid for exposing the condiment pouch within the container.

A more particular object of this invention is to provide a container, as aforesaid, having flanges extending from the sides thereof for support upon the user's fingers.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
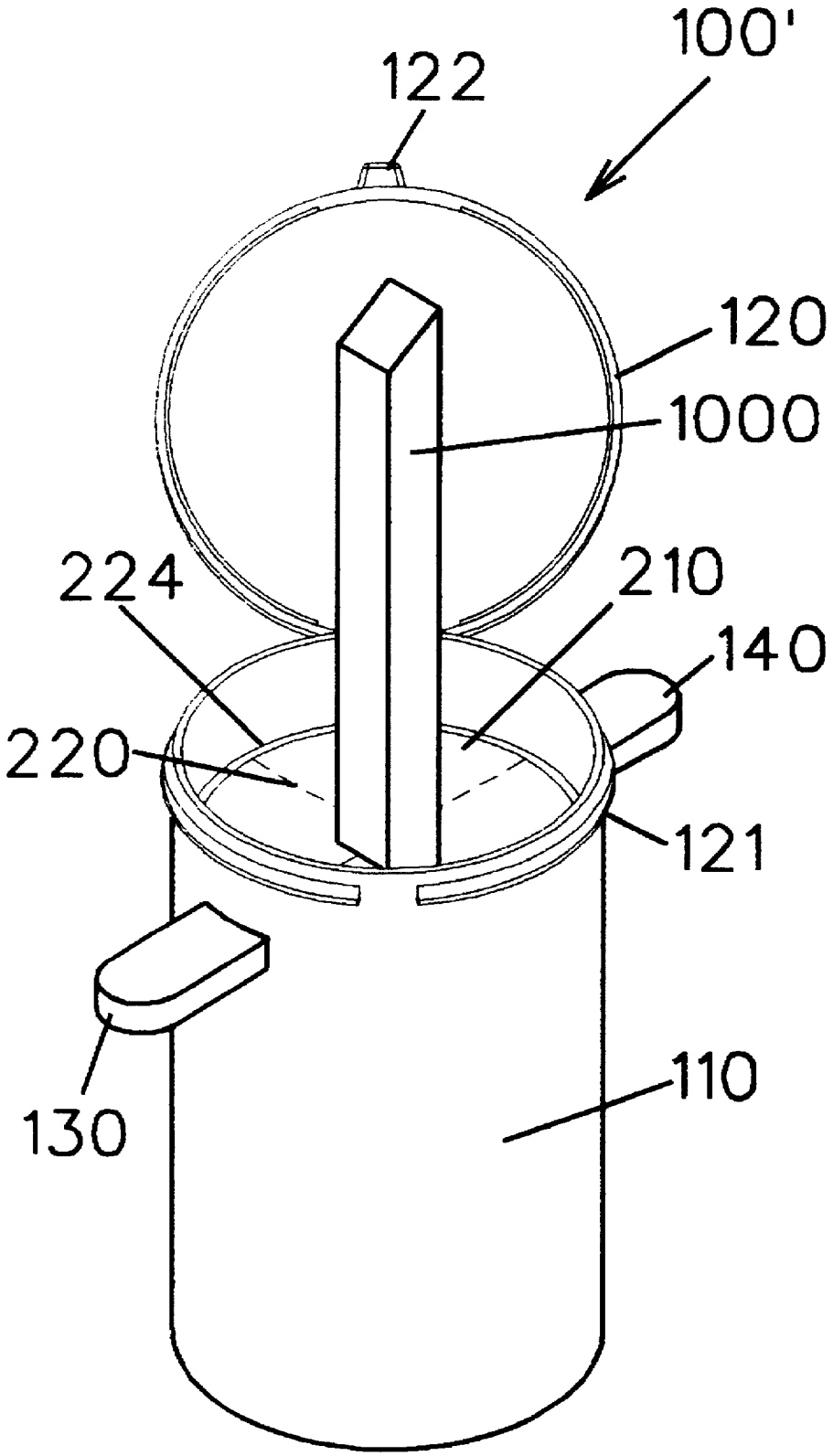
FIG. 1 is a perspective view of a first embodiment of an open condiment container with a french fry being inserted therein.
Figure 2:
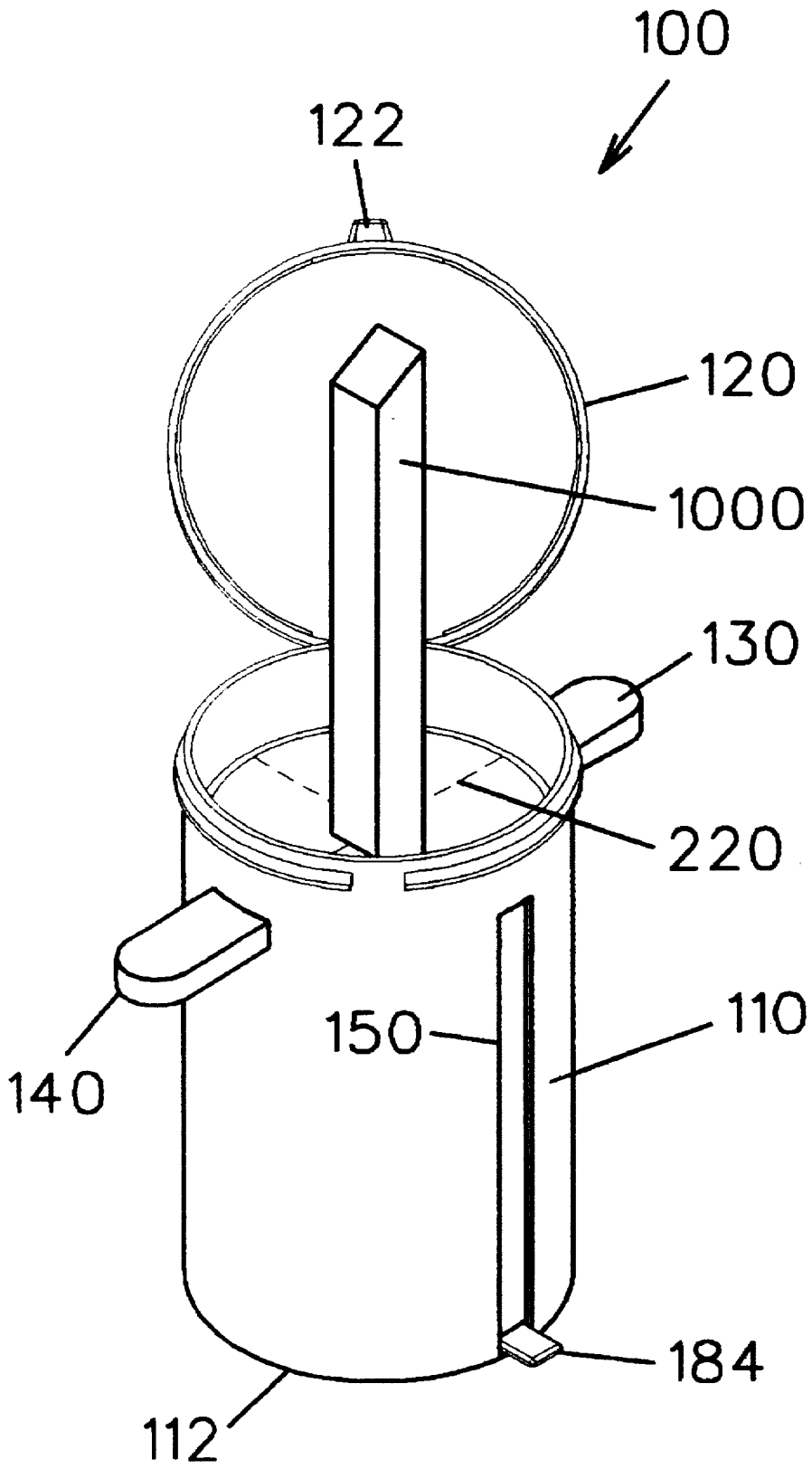
FIG. 2 is a perspective view of a second embodiment of the container of FIG. 1.
Figure 3:
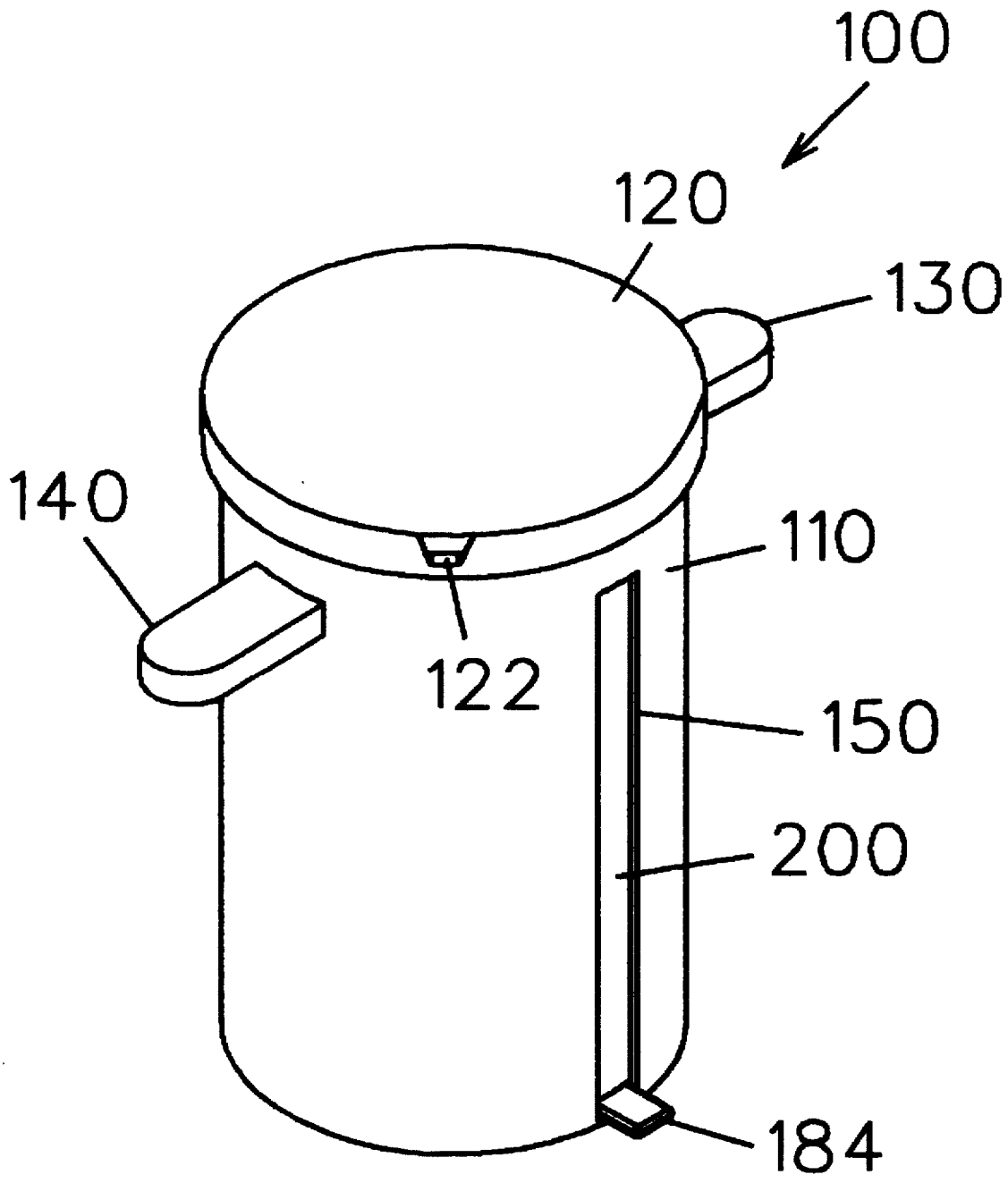
FIG. 3 is a perspective view of the closed container of FIG. 2 showing the condiment pouch before score line separation.
Figure 4:
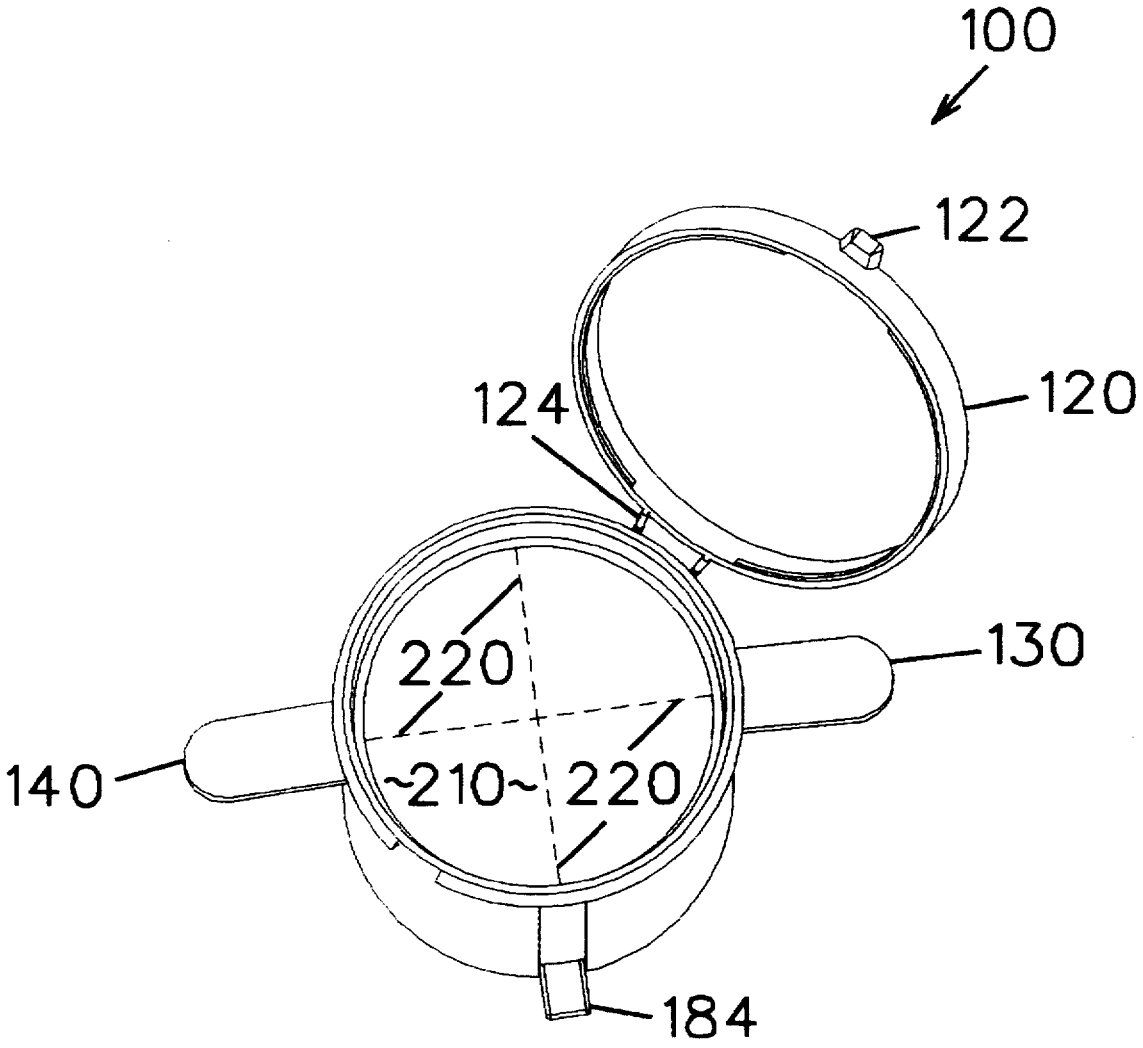
FIG. 4 is a top perspective view of the container of FIG. 2.
Figure 5:
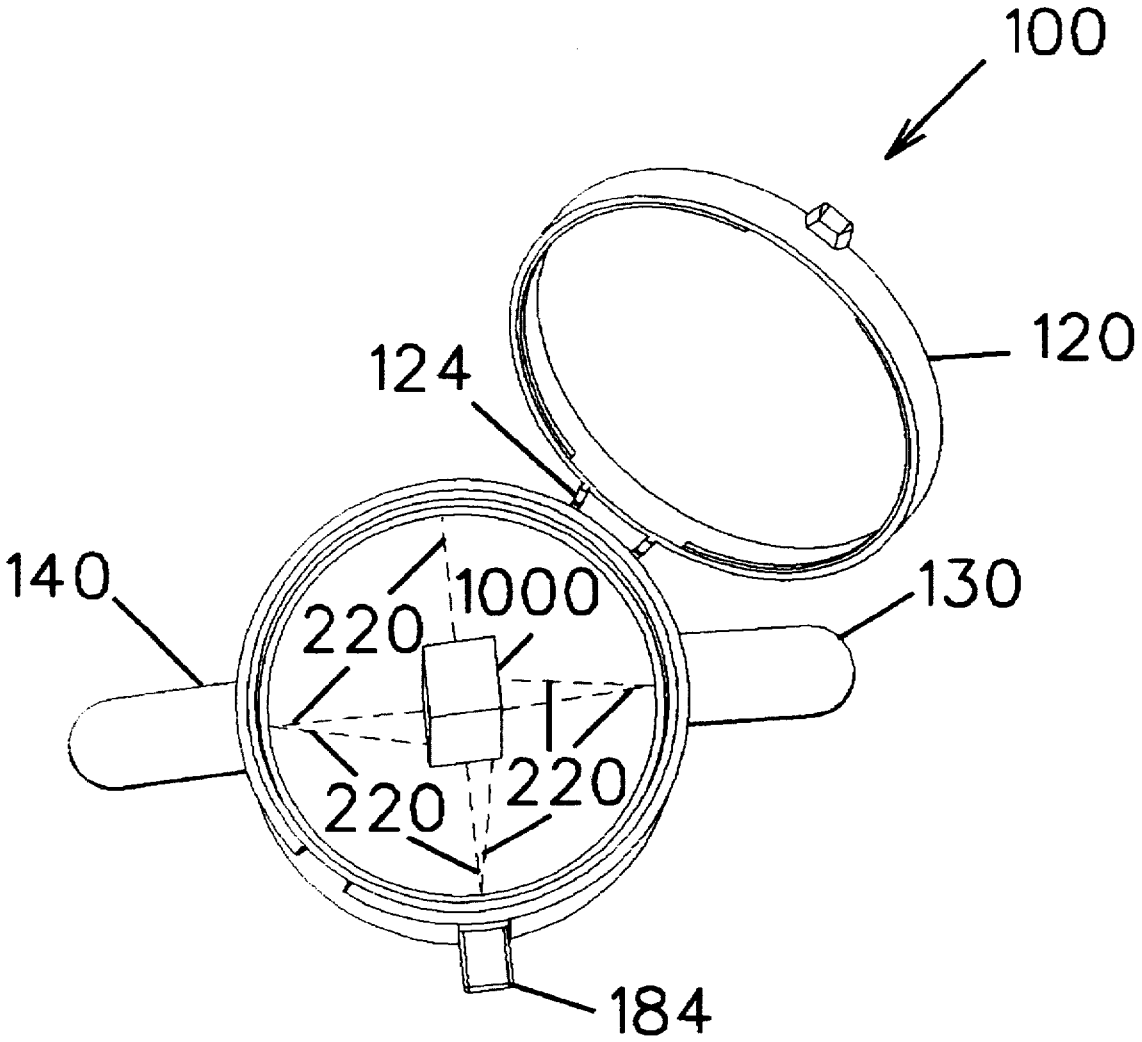
FIG. 5 is a top perspective view of the container of FIG. 2 with a french fry inserted therein.
Figure 6:
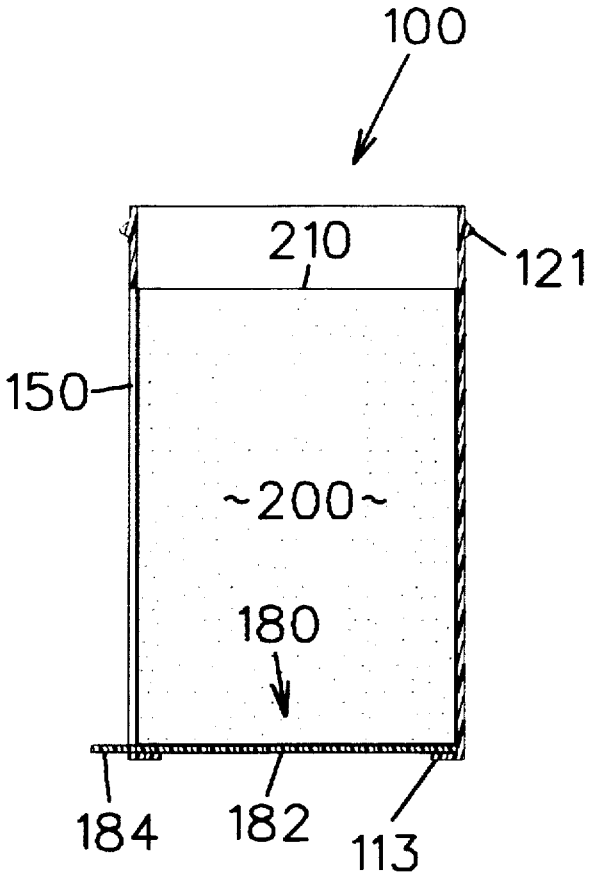
FIG. 6 is a sectional elevation view of the FIG. 2 container, taken along the longitudinal centerline thereof, showing the relationship among the housing, movable base and the condiment pouch therein.
Figure 7:
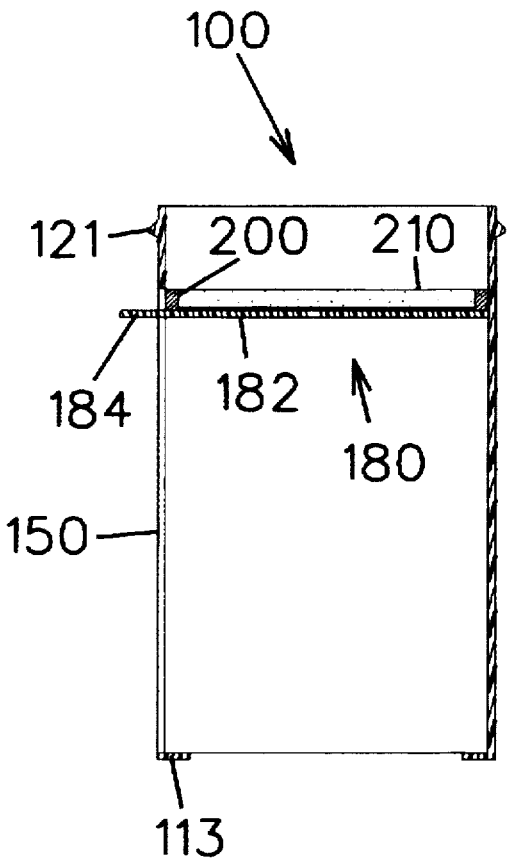
FIG. 7 is a sectional elevation view, as in FIG. 6, showing the movable base adjacent the top end of the FIG. 2 container.
Figure 8:
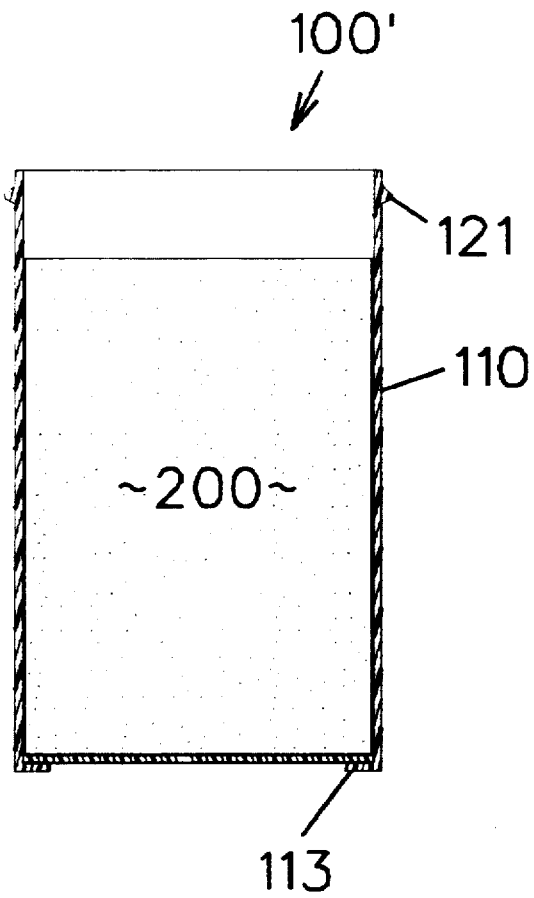
FIG. 8 is a sectional elevation view of the FIG. 1 container, taken along the longitudinal centerline thereof, showing the relationship among the housing, movable base and the condiment pouch therein.
Figure 9:
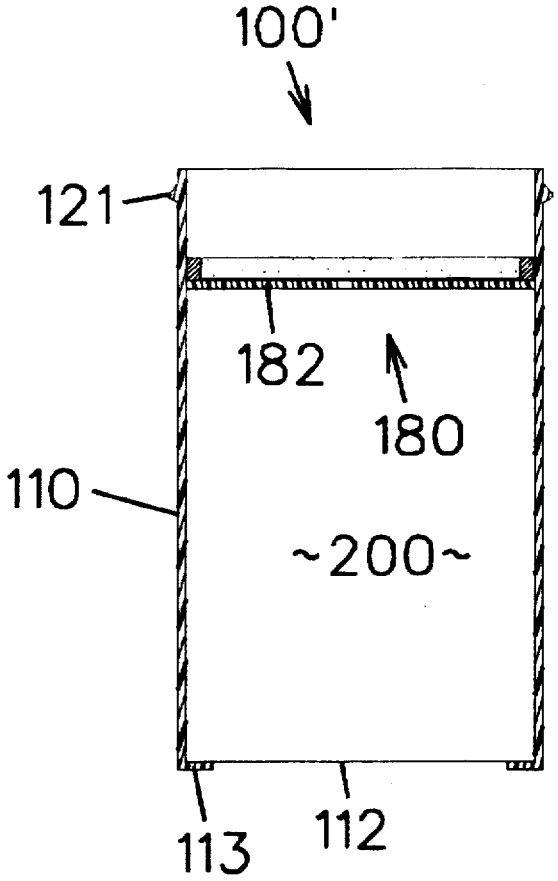
FIG. 9 is a sectional elevation view, as in FIG. 8, showing the movable base adjacent the top end of the FIG. 1 container.
Figure 10:
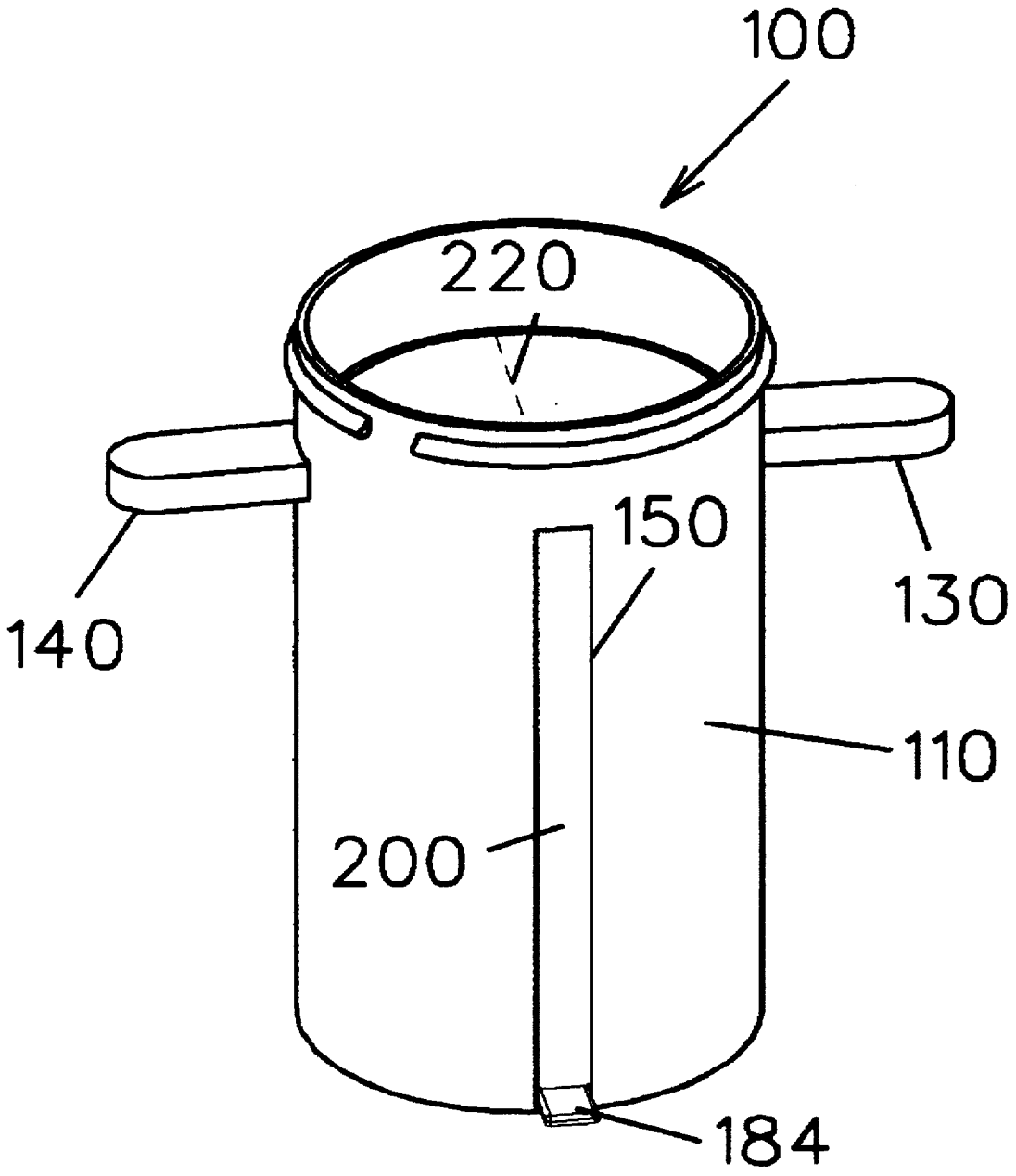
FIG. 10 is a front perspective view of the FIG. 2 container with the lid removed.
Figure 11:
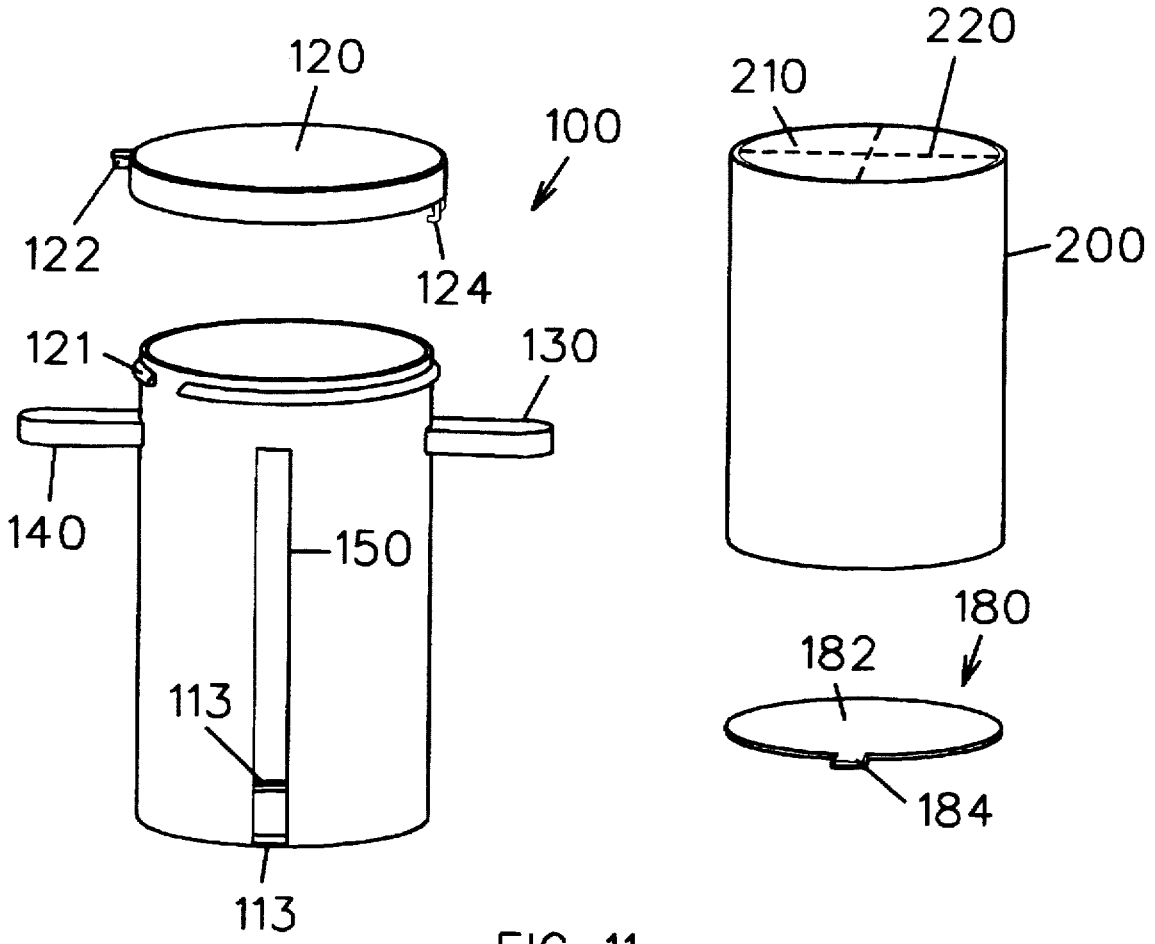
FIG. 11 is an exploded view of the elements of the container of FIG. 2.

Turning more particularly to the drawings, FIGS. 1 and 2 show first and second embodiments of condiment containers 100', 100 with identical elements being designated with identical numerals. Each container 100', 100 comprises a generally cylindrical housing 110 made of a flexible material. Swingably attached to the top of the cylindrical housing 110 via hinge 124 is a lid 120. Lid 120 is swingable between the open FIGS. 1, 2 positions and a closed position as shown in FIG. 3. Lid 120 is configured to snap fit about annular flange 121 when in a closed position. A flange 122 extends from lid 120 for user purchase on the lid 120 by exertion of a user's thumb thereon.

Located within the housing 110 and initially adjacent the housing base 112 is a movable base assembly 180. The base 182 is configured to be in a friction fit relationship with the interior configuration of housing 110 and in slidable movement therein. In embodiment 100' housing 110 presents an opening at the bottom thereof so as to provide access to base 182 which rests on annular flange 113. Upon the user exerting pressure on base 182, the base 182 will slide upwardly through housing 110. In the FIG. 2 embodiment, a tab 184 extends from base 182 and through a vertical slot 150 in housing 110 wall. Upon user movement of the tab 184 through the slot 150, the base 182 moves upwardly through the slot 150.

Further included in the housing 110 is a condiment pouch 200 made of a collapsible material. The pouch 200 includes an originally sealed 210 top surface having a plurality of score lines 220 therein.

In use the desired condiment pouch 200, such as ketchup, is housed within the container with the top 224 of pouch being fixed to the housing wall. Upon a person ordering a fastfood product the closed container 100' or 100 is provided to the purchaser. Opposed handles 130, 140 extend from the housing 110 wall which rest upon the user's fingers. Upon the user squeezing the housing 110, the score lines 220 in the top surface 210 of the condiment pouch 200 will separate to present an opening to allow access to the condiment within the pouch 200. Lid 120 is then swung about hinge 124 from its closed position to its open position by thumb pressure being exerted on flange 122. The user then inserts the food product through the separated score lines 220, such as a french fry 1000, and into the condiment found within the pouch 200. Upon withdrawal of the french fry 1000 from the pouch 200 the free edges of the opening of pouch 200 wipe the excess condiment off the french fry 1000.

The movable base 180 assembly can be urged upwardly by either exerting pressure directly on base 182, as shown in FIG. 1 embodiment, or on the tab 184 extending through the slot 150 (FIG. 2). During base 182 movement the pouch 200 collapses causing the condiment to be urged towards the top of pouch and/or through the separated score lines 220 of the pouch 200. As the handles 130, 140 overlie the index and middle fingers of the use with the user's thumb on the tab 184, the container 100 can be operated like a syringe. After eating, the lid 120 can then be returned to its closed position.

Accordingly, the containers 100, 100' allow one hand to manipulate the food product while the condiment container is held in the other hand. Moreover, the lid 120 closes the container after use. This structure 100, 100' thus precludes the normal messiness associated with dispensing condiments on food products, particularly fastfoods in a moving vehicle.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A condiment container device comprising:

a housing having a bottom and a top end;

a pouch adapted for containing a condiment and positioned within said housing;

a lid on said top end of said housing movable between open and closed positions, said open position allowing for access to said housing and said pouch therein;

inlet means in a top of said pouch for access of a food product into the condiment within said pouch;

a base mounted underneath a bottom of said pouch and is in slidable movement between said bottom and top ends of said housing and;

means extending from said base and through said housing for a user pressure thereon, the user pressure sliding said base from said bottom end of said housing to said top end thereof, said base movement urging said bottom of said pouch towards said pouch top, whereby to urge the condiment in said pouch towards said inlet means.

2. The device as claimed in claim 1 wherein said user pressure means further comprises:

a vertical slot in said housing extending between said bottom and top housing ends;

a tab attached to said base and extending through said slot to an exterior of said housing, said user pressure on said tab moving said base from a bottom end of said housing to said top end thereof.

3. The device as claimed in claim 1 further comprises at least one handle extending from a side of said housing.

4. The device as claimed in claim 1 wherein said inlet means comprises:

at least one score line in said top of said pouch, a user pressure on said score line causing said at least one score line to separate therealong whereby to provide an opening for said access to said pouch.

5. The device as claimed in claim 4 wherein said housing is made of a flexible material, a user pressure on said flexible housing separating said at least one score line.

6. The device as claimed in claim 4 wherein said opening presents at least one edge, said at least one edge contacting a food product inserted in said opening for wiping excess condiment off the product upon withdrawal of the product from said pouch.

7. The device as claimed in claim 1 wherein said inlet means comprises a plurality of score lines in said top of said pouch, a separation of said score lines presenting an opening for said access to said pouch for insertion of the food product into said pouch and at least one edge for removing condiment from the food product upon withdrawal of the food product from said pouch.

8. A food container device comprising:

a housing;

a compartment within said housing adapted for containing a food product therein, said compartment presenting a surface within said housing;

inlet means in said compartment surface for accessing the food product in said compartment;

a base slidably mounted within said housing and spaced from said compartment surface;

a vertical slot along said housing between said base and said surface;

a tab attached to said base and extending through said slot, a user pressure on said tab moving said base through said housing and towards said compartment surface whereby to urge the food product in the compartment towards said inlet means.

9. The device as claimed in claim 8 further comprising first and second handles extending from opposed sides of said housing.

10. The device as claimed in claim 8 wherein said inlet means comprises:

at least one score line in said compartment surface, a user pressure on said score line causing a separation along said score line to present an opening into said pouch.

* * * * *